United States Patent [19]

Tesney

[11] Patent Number: 4,823,709

[45] Date of Patent: Apr. 25, 1989

[54] APPARATUS AND METHOD FOR ATTACHING A TABLE LEG TO A TABEL TOP

[75] Inventor: Bobby Tesney, Haleyville, Ala.

[73] Assignee: Winston Furniture Company Inc., Birmingham, Ala.

[21] Appl. No.: 103,702

[22] Filed: Oct. 2, 1987

[51] Int. Cl.[4] ..... A47B 3/06

[52] U.S. Cl. ..... 108/157; 248/231.2

[58] Field of Search ..... 108/157, 27, 153, 161; 248/316.1, 316.2, 231.2, 165; 312/137, 140.1, 140.2, 140.3, 140.4; 24/606, 607, 608, 461

[56] References Cited

U.S. PATENT DOCUMENTS

| | | | |
|---|---|---|---|
| 525,756 | 9/1894 | Bennet | 108/157 |
| 1,123,592 | 1/1915 | Ralph | 108/157 X |
| 1,240,390 | 9/1917 | Uhl | 108/158 |
| 1,253,346 | 1/1918 | Burjanek | 108/158 |
| 1,581,257 | 4/1926 | Wege | 108/158 |
| 1,697,094 | 1/1929 | Turk | 108/157 |
| 1,795,138 | 3/1931 | Ohnstrand et al. | 108/157 |
| 1,966,700 | 7/1934 | Armstrong | 248/165 |
| 2,172,687 | 9/1939 | Anderson et al. | 248/188.8 |
| 2,591,797 | 4/1952 | Eline et al. | 108/157 X |
| 2,746,823 | 3/1956 | Sand | 248/165 |
| 2,783,519 | 3/1957 | Leens | 312/140.3 X |
| 2,843,435 | 7/1958 | Hoven et al. | 108/158 |
| 3,013,851 | 12/1961 | Maron | 312/140.4 |
| 3,174,384 | 3/1965 | Vanni | 24/607 X |
| 3,215,381 | 11/1965 | Ching | 108/157 X |
| 3,267,889 | 8/1966 | Dedoz | 108/157 |
| 3,366,079 | 1/1968 | Koransky et al. | 108/157 |
| 3,643,608 | 2/1972 | De Cesaris | 108/157 |
| 3,711,173 | 1/1973 | Hoffman | 312/140.4 |
| 4,003,320 | 1/1977 | Owens et al. | 108/157 |
| 4,488,698 | 12/1984 | Delafield | 248/188 |
| 4,503,780 | 3/1985 | Apissomian | 108/27 |
| 4,708,183 | 4/1987 | Figueroa | 248/316.1 X |

FOREIGN PATENT DOCUMENTS

| | | | |
|---|---|---|---|
| 01868 | 7/1930 | Australia | 24/608 |

*Primary Examiner*—Kenneth J. Dorner
*Assistant Examiner*—José Chen
*Attorney, Agent, or Firm*—Shlesinger, Arkwright & Garvey

[57] ABSTRACT

An assembly for securing a leg of a table or the like comprises a table top including first and second spaced flanges. A clip for being secured to a leg includes a first support engageable with the first flange and first and second juxtaposed hingedly connected leg members, with one of the members engageable with the second flange. A screw forces the members apart so that the first support is forced securely against the first flange and the one member is forced securely against the second flange.

18 Claims, 2 Drawing Sheets

APPARATUS AND METHOD FOR ATTACHING A TABLE LEG TO A TABLE TOP

BACKGROUND OF THE INVENTION

Furniture should be functional, relatively easy to assemble and aesthetically pleasing. These requirements are sometimes in conflict. Furthermore, the ever changing nature of modern furniture materials also has an impact on these requirements. For example, transparent or translucent materials, such as glass, should also have the capability of being cleaned and this may require removal of the glass from the table.

Furniture manufactures are continuously seeking new methods of assembling their furniture, as well as reducing labor and material costs attributable thereto. The prior art discloses a number of mechanisms for attaching the legs of a table to the table top. For example, it is conventional to weld the legs to the metal rim of a table, to screw or bolt the legs directly to the table top and to connect the legs in a manner which causes the connection to be hidden. None of these various mechanisms, on the other hand, is particularly well suited for the rapid and secure attachment of a metal leg to a glass topped table.

In view of the above, those skilled in the art will appreciate that there is a need for an apparatus and method which permits the legs of a glass topped table to be securely attached thereto in a manner which permits the table to be rapidly assembled, the top to be cleaned and the table to be sturdy. The disclosed invention is just such an apparatus and method and one that can be manufactured from extruded aluminum or plastic parts, and one merely requiring the use of a screwdriver for assembly and disassembly of the table.

OBJECTS AND SUMMARY OF THE INVENTION

The primary object of the disclosed invention is an apparatus and method for rapidly and securely attaching the legs of a table to the table top.

An assembly for securing a leg of a table or the like comprises table top means including first and second spaced flange means. Clip means are provided for being secured to a leg and include first means engageable with the first flange means and second means comprising first and second juxtaposed hingedly connected leg members, one of the leg members engageable with the second flange means. Means are provided for forcing the members apart so that the first means is forced securely against the first flange means and the one member is forced securely against the second flange means.

The method of securing a leg to a table top or the like comprises the steps of providing a table top assembly including a top and a rim. The rim has first and second spaced flanges and a section extending therebetween and the top bears upon the underside of the first flange. A leg is provided and has clip means at one end thereof. The clip means includes first means for bearing against the top and second means comprising first and second juxtaposed hingedly connected members. The clip means is positioned between the flanges so that the first means bears against the table top and one of the members engages the second flange. The members are then forced and maintained apart so that the first means causes the top to be secured against the first flange and the one member is secured to the second flange.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
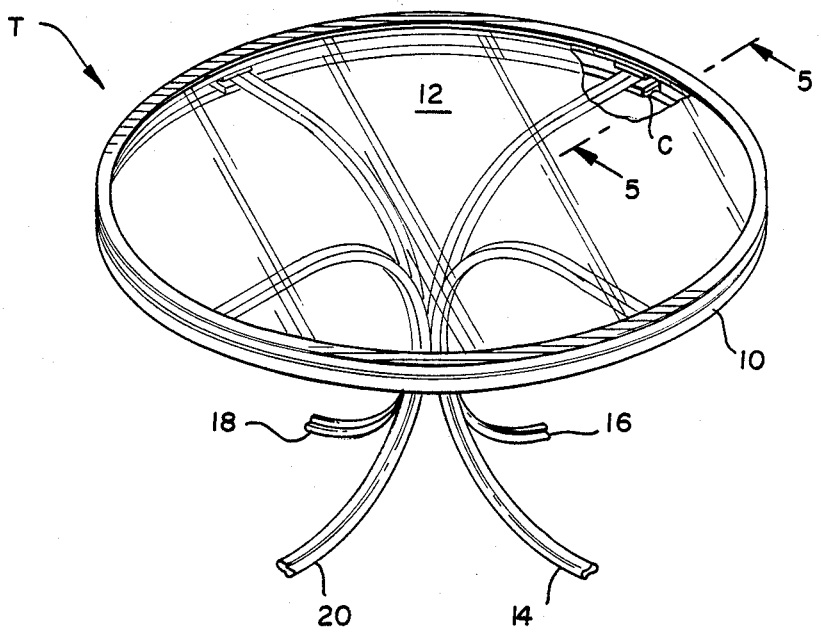
FIG. 1 is a perspective view with portions broken away illustrating a table assembled through use of invention.
Figure 2:
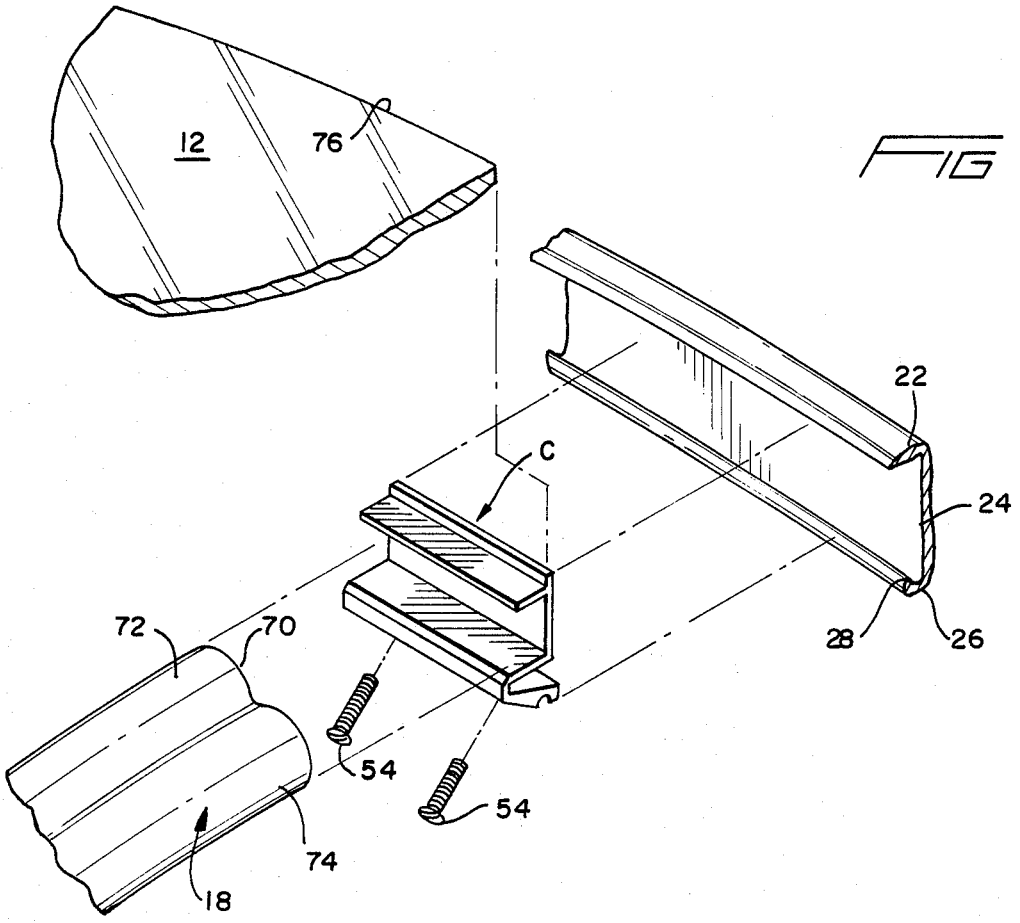
FIG. 2 an exploded fragmentary assembly drawing of the invention.

Table T, as best shown in FIG. 1, includes circular rim 10 which surrounds glass top 12. Legs 14, 16, 18 and 20 are secured to rim 10 by clips C, as will be further explained.

Figure 5:
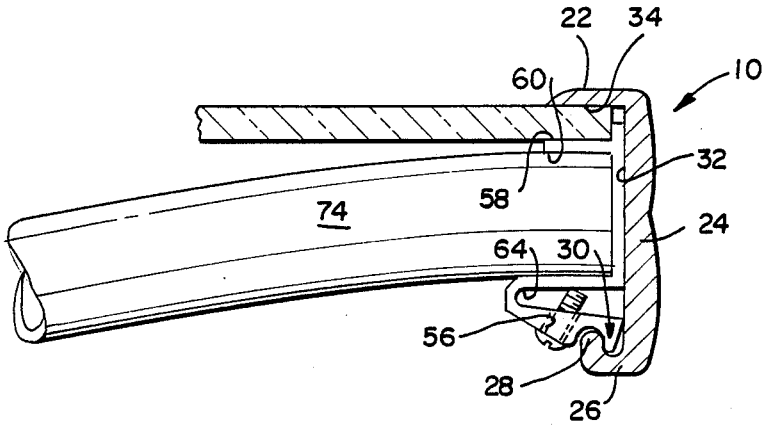

Rim 10, as best shown in FIG. 5, has upper flange 22 which is connected to vertical section 24. Lower flange 26 extends from vertical section 24 in alignment with upper flange 22. Lower flange 26 has gently rounded lip 28 extending upwardly therefrom toward upper flange 22. The lip 28 forms a groove or annular recess 30 with straight wall section 32 of vertical section 24. Preferably, upper flange 22 has a lower flat surface 34 extending generally transverse to wall section 32.

Figure 3:
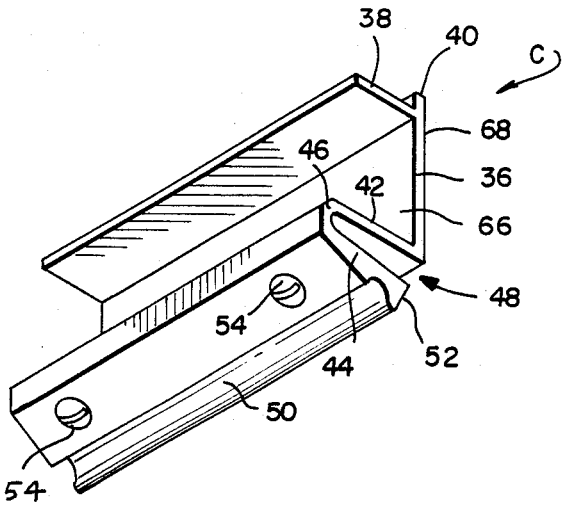
FIG. 3 is a perspective view of the clip of the invention.
Figure 4:
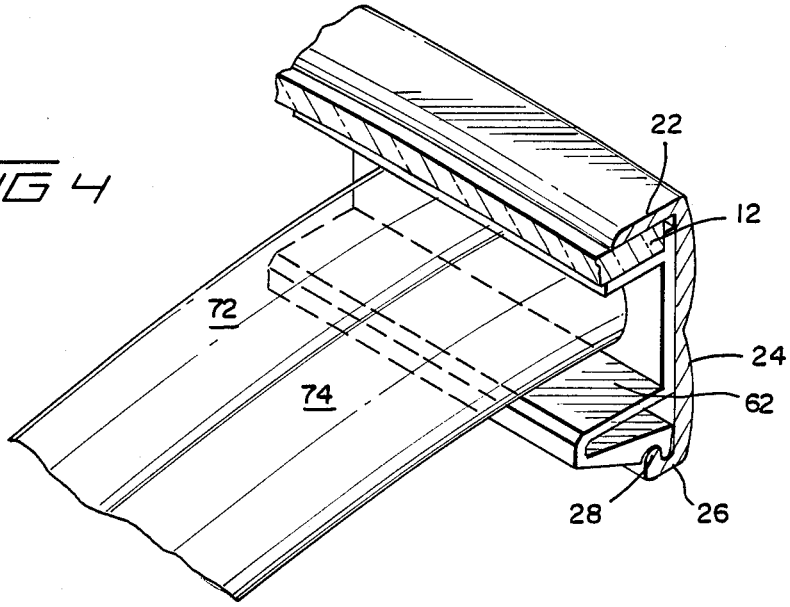
FIG. 4 is a fragmentary perspective view, partially in section, illustrating the clip of the invention positioned within the rim of the table; and, FIG. 5 is a fragmentary cross-sectional view taken along the section 5—5 of FIG. 1 and viewed in the direction of the arrows.

Clip C, as best shown in FIG. 3, includes a flat vertical element 36 from which support 38 extends transversely thereto. Vertical positioning element 40 extends from support 38 in alignment with flat element 36, for reasons to be explained.

First leg member 42 extends from flat element 36 in general alignment with and spaced from support 38. Second leg member 44 extends from integral hinge 46 of first leg member 42. In this way, the leg members 42 and 44 are juxtaposed and have a generally U-shaped opening 48 extending therebetween. Groove 50 extends along second leg member 44 adjacent end 52 thereof and has a shape conforming to the shape of lip 28, for reasons to be explained.

Screws 54 extend through threaded holes 56, only one of which is illustrated in FIG. 5, in second leg member 44 and bear upon first leg member 42.

Support 38 has an upper flat surface 58 and a lower flab surface 60, as best shown in FIG. 5. Similarly, first leg member 42 has an upper flat surface 62 and a lower flat surface 64 upon which the screws 54 bear. Also, flat element 36 has first and second flat surfaces 66 and 68, for reasons to be explained.

Each of the legs 14, 16, 18 and 20 has an end 70 which is secured to flat surface 66, preferably by welding or the like. Each of the legs is, preferably, of tubular construction and has conforming secured together tubular elements 72 and 74. The tubular elements 72 and 74 have a height or diameter substantially equal to the distance separating lower surface 60 from upper surface 62 so that the tubular elements 72 and 74 are sandwiched therebetween. Also, the elements 72 and 74 may thereby be secured to the support 38, such as by welding or the like.

The rim 10 is, preferably, made of metal, such as extruded aluminum. I prefer this material because it is relatively inexpensive, can be readily formed into a desired shape and is lightweight. Also, preferably, the legs 14, 16, 18 and 20 are likewise formed of extruded aluminum for similar reasons. The clips C are also of extruded aluminum, although they could be made of a tough plastic, so that the leg members 42 and 44 can flex about hinge 46. Extruded aluminum does have sufficient elasticity to permit the legs 42 and 44 to flex apart to a sufficient extent for my purposes.

Assembly of the table T and attachment of the legs 14, 16, 18 and 20 through use of the clips C is relatively straightforward, requires no special tools and can be done quite rapidly. In fact, disassembly can likewise be accomplished rapidly in order to permit thorough cleaning of the table T and its related components.

The glass top 12 is, preferably, secured to rim 10. The top 12 is, preferably, adhesively secured to flat surface 34 in order to be permanently affixed thereto.

Each of the legs 14, 16, 18 and 20 is secured to one of the clips C, such as by welding. As noted, the end 70 is positioned contiguous with flat surface 66 in order to properly align the associated leg within the clip C, thereby assuring that each leg will position the top 12 at the same height relative to the floor. The clips C are each inserted between the flanges 22 and 26 so that the vertical element 40 is positioned between the edge 76 of top 12 and wall section 32 and support 38 engages top 12. Similarly, groove 50 is positioned onto lip 28 so that end 52 is received within groove 30. The clip C is thereby loosely positioned within rim 10 and can be slid about the rim 10 to the appropriate position. After being properly circumferentially positioned about rim 10, then the screws 54 are tightened so that the members 42 and 44 are caused to flex about hinge 46. Flexing of the members 42 and 44 cause the leg member 44 to be securely positioned against the lip 20 while the upper surface 58 of support 38 is securely pressed against top 12. Both screws 54 should be tightened so that the clip C is locked in position within rim 10.

I have found that disassembly of the table T can likewise be performed rapidly in order to permit top 12 to be cleaned or replaced. All that is required is that the screws 54 be loosened, so that the leg members 42 and 44 return to their initial unstressed position, thereby once again loosely positioning the clip C between the flanges 22 and 26. The clip C can then be removed from the rim 10 by merely removing the groove 50 from the keying lip 28.

Those skilled in the art will understand that the clip C of the invention can be used to fit a wide variety of rims 10 or legs simply by changing the appropriate dimensions of the rim 10 and the clip C. Furthermore, the rim 10 can have any desired configuration, and need not be circular as shown in FIG. 1. The clip C of the invention, in combination with the rim 10 provides secure attachment of the legs to the rim 10 in a manner achieving rigidity greater than that available in the prior art, and merely requires a screwdriver.

While this invention has been described as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What I claim is:

1. An assembly for securing a leg of a table or the like, comprising:

(a) table top means including first and second spaced flange means;

(b) clip means for being secured to a leg and including first means engageable with said first flange means and second means comprising first and second juxtaposed hingedly connected leg members, one of said members engageable with said second flange means; and, (c) means for forcing said members apart so that said first means is forced securely against said first flange means and said one member is forced securely against said second flange means.

2. The assembly of claim 1, wherein:

(a) said one member includes a first positioning means; and, (b) said second flange means includes a second positioning means cooperating with said first positioning means for aligning said clip means.

3. The assembly of claim 2, wherein:

(a) said second positioning means including a lip extending from said second flange means; and, (b) said first positioning means including a groove in said one member positionable about said lip.

4. Thc assembly of claim 1, wherein:

(a) said forcing means including screw means extending through one of said members and bearing upon the other of said members.

5. The assembly of claim 4, wherein:

(a) said screw means extending through said one member.

6. The assembly of claim 1, wherein said table top means including:

(a) a rim having first and second spaced flanges;

(b) a table top being disposed between said flanges and bearing upon said first flange; and, (c) said first means bearing upon said table top.

7. The assembly of claim 6, wherein said first means including:

(a) a support extending in alignment with said members and bearing upon said table top for forcing said table top against said first flange.

8. The assembly of claim 7, wherein:

(a) said rim including a straight section extending between said flanges; and, (b) said clip means including a first straight element interconnecting said support and said second means and being contiguous with said straight section.

9. The assembly of claim 8, wherein:

(a) a second straight element extending from said support along said straight section and being engaged with an edge of said table top.

10. The assembly of claim 8, wherein:

(a) a leg being secured to and extending from said first straight element of said clip means.

11. The assembly of claim 1, wherein:

(a) said clip means being an extruded aluminum element.

12. A table, comprising:

(a) a rim defining a bounded space of preselected configuration, said rim including first and second flanges and a member extending therebetween;

(b) a table top having said preselected configuration positioned within said rim and bearing upon said first flange;

(c) a plurality of clip means disposed about said rim, each clip means including a support bearing against said top and a pair of hingedly connected members and one of said members bearing upon said second flange;

(d) means forcing said members apart so that said support securely engages said first flange and said one member is forced securely against said second flange for thereby securing said clip means at a preselected position; and, (e) a table leg secured to and extending from each of said clip means for thereby supporting said table top in a generally horizontal orientation.

13. The table of claim 12, wherein:

(a) said forcing means including a plurality of screw means, each of said screw means extending through said one member and bearing against the other member so that rotation of said screw means causes said members to be forced and maintained apart.

14. The table of claim 12, wherein:

(a) lip means extending about said second flange; and, (b) each of said one members including a groove positionable over said lip means for keying the clip means to said rim.

15. The table of claim 12, wherein:

(a) each of said members having a straight portion;

(b) each of said clip means including a first straight element extending between said support and said members and being positioned contiguous with said straight portion; and, (c) each of said table legs secured to and extending from the associated said first straight element of said clip means.

16. The table of claim 15, wherein:

(a) a positioning member extending from each of said supports in alignment with the associated first straight element, said positioning members bearing upon said member and an edge of said table top for positioning said table top within said rim.

17. The table of claim 12, wherein:

(a) there being at least four clip means disposed about said rim; and, (b) said table top being non-opaque.

18. The table of claim 12, wherein:

(a) each of said clip means being an extruded aluminum element.

* * * * *